United States Patent [19]

Pagani

[11] 4,250,899

[45] Feb. 17, 1981

[54] CIGARETTE PUNCHER

[76] Inventor: Franco Pagani, 1100 Newportville Rd., Apt. 908, Croydon, Pa. 19020

[21] Appl. No.: 54,578

[22] Filed: Jul. 3, 1979

[51] Int. Cl.[3] ..... A24F 47/00; A24F 13/24

[52] U.S. Cl. ..... 131/170 R; 131/185; 131/254

[58] Field of Search ..... 131/253, 254, 170 R, 131/185, 233; 431/343; 30/123; 206/254, 255, 804

[56] References Cited

U.S. PATENT DOCUMENTS

| | | | |
|---|---|---|---|
| 826,299 | 7/1906 | Willis | 131/254 |
| 1,999,688 | 4/1935 | Elliott | 131/254 |
| 2,258,170 | 10/1941 | Austin et al. | 206/254 X |
| 2,854,010 | 9/1958 | Stamm | 131/170 R |
| 2,983,044 | 5/1961 | Stein | 131/170 R X |
| 3,608,704 | 9/1971 | Kopp | 431/343 |
| 3,701,353 | 10/1972 | Pasquine et al. | 131/254 X |

FOREIGN PATENT DOCUMENTS

| | | | |
|---|---|---|---|
| 1957229 | 6/1970 | Fed. Rep. of Germany | 131/170 R |

*Primary Examiner*—Stephen C. Pellegrino
*Attorney, Agent, or Firm*—Mason, Fenwick & Lawrence

[57] ABSTRACT

A cigarette puncher comprising a body member having a clip portion and a punch support portion, an elongated guide slot in the body member has a width permitting the snug insertion of the end of a cigarette therein and an elongated punch member is mounted in one end of the elongated guide slot. In one embodiment, plural punch members are provided on a rotary turret. In a second embodiment, a single punch is provided on the lower end of a cigarette light connected to the clip portion. In both embodiments, the clip portion is dimensioned to be received in one end of a cigarette pack.

8 Claims, 11 Drawing Figures

FIG-1
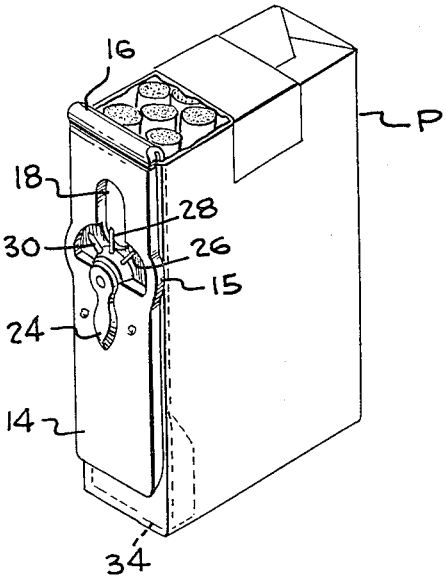
FIG-2
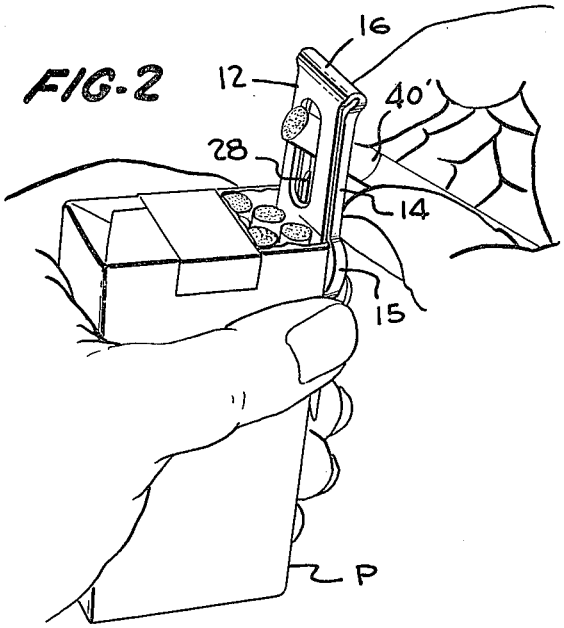
FIG-5.B
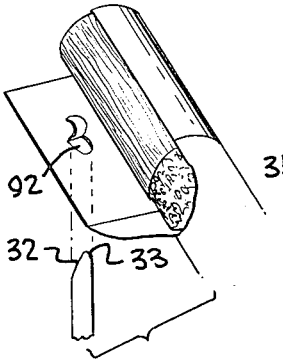
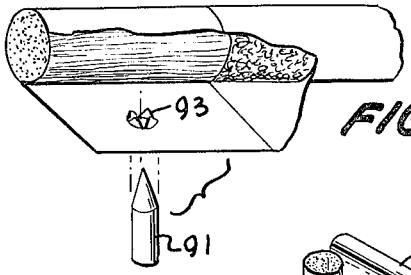
FIG-5.C
FIG-3
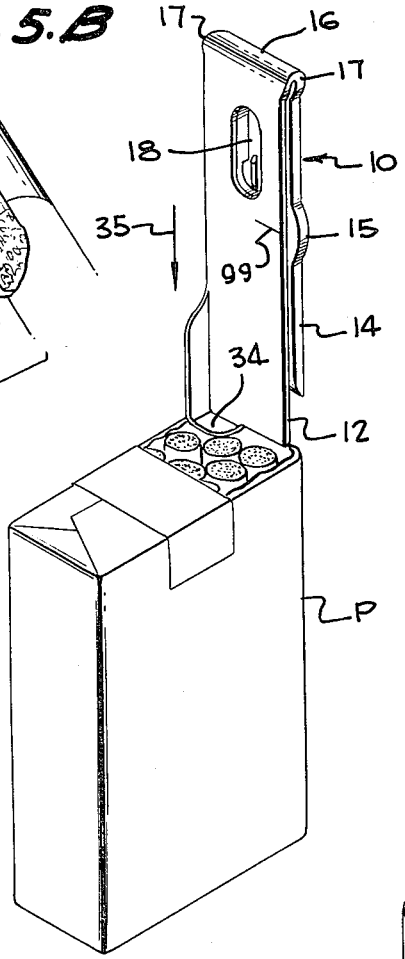
FIG-4
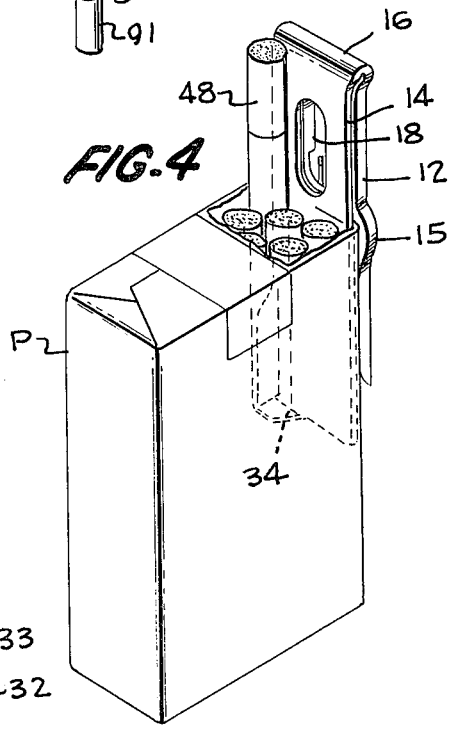
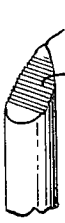
FIG-5.A FIG-6
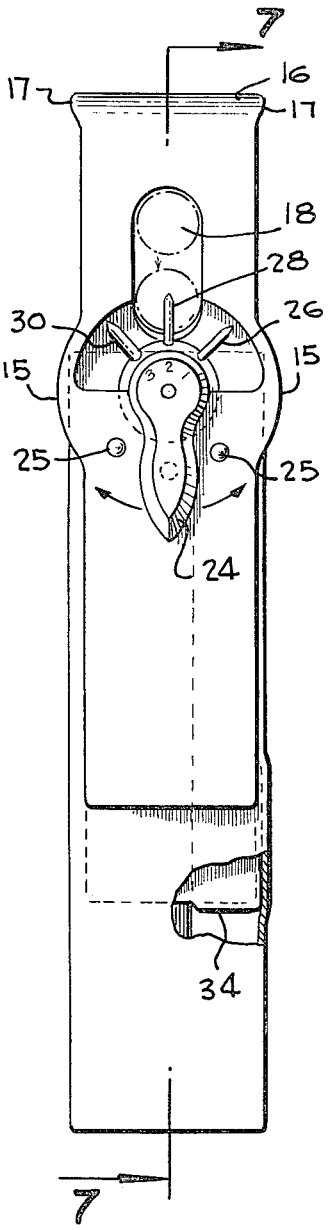
FIG-7
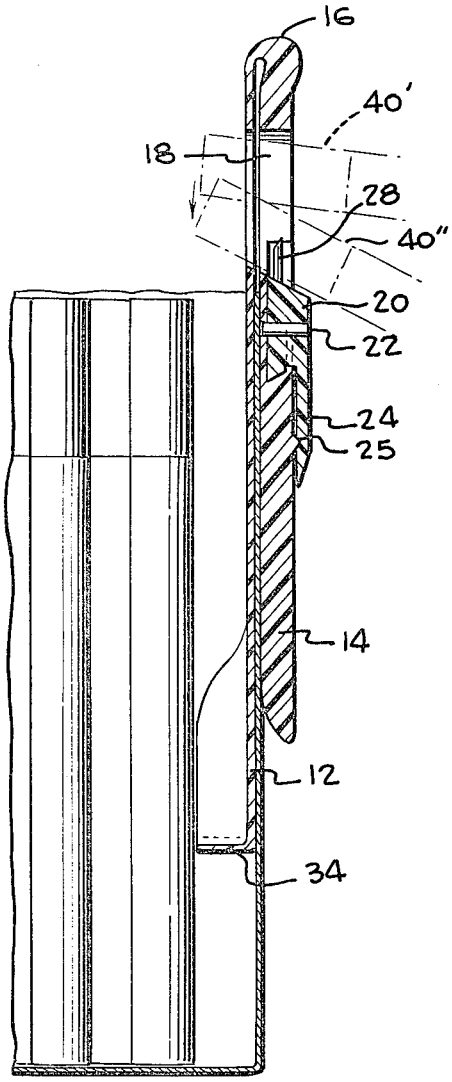
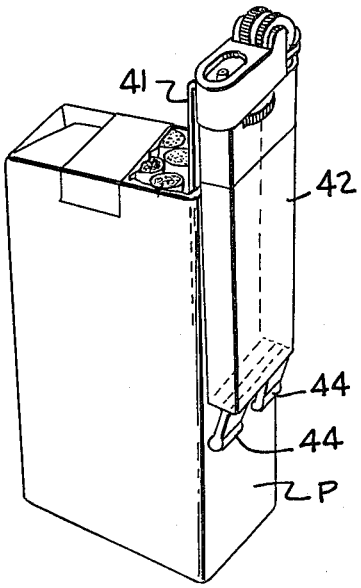
FIG-8
FIG-9
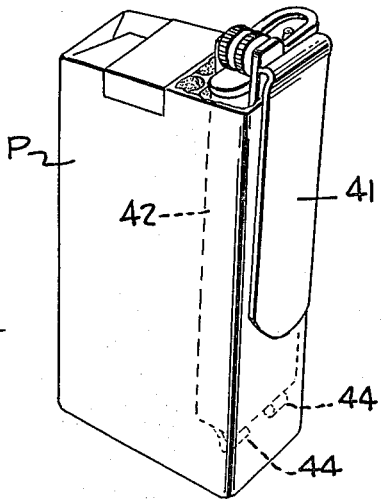
FIG-10
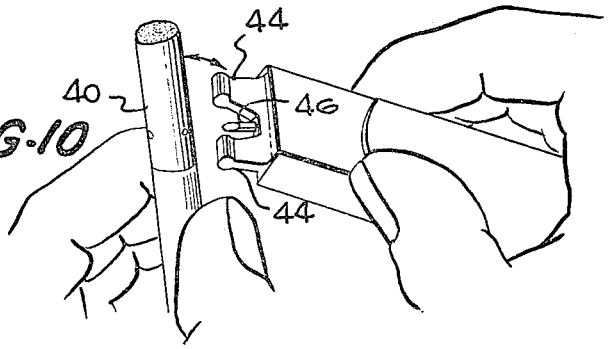

CIGARETTE PUNCHER

This invention is in the field of smoking utensils and is more particularly directed to cigarette punch means for providing air infeed openings in the paper of a cigarette to reduce the percentage of combustion products in the gas mixture flowing to the user. Even more specifically, the present invention in one embodiment is directed to a selectively operable cigarette puncher capable of providing apertures in the cigarette paper of varying size in accordance with a manual setting on the device so as to permit variation of the amount of air flowing into different cigarettes. In another aspect of the invention, the punch means is provided in conjuction with a lighter for the sake of convenience with both embodiments being mountable in the side edge of an opened cigarette pack and with the first embodiment providing a lift tab inside the pack for effecting the lifting of a single cigarette from the pack by upward movement of the device.

It is well documented and established that the product of combustion in cigarette smoke create a health hazard to users which increases the likelihood of such serious diseases as cancer, heart trouble and high blood pressure. One way in which the percentage of tars and the like in smoke can be reduced for those persons who smoke is by the use of expensive tobacco and/or by treating the tobacco prior to its inclusion in the cigarette. Such expedients are quite expensive and increase the cost of cigarettes and also frequently suffer from the disadvantage of not being acceptable to the user for a variety of reasons, such as weak taste and emotional dissatisfaction occasioned by the fact that the user is aware that he is not smoking his favorite brand. While prior devices have been suggested for providing air inflow apertures in cigarettes, none of these devices has met with any substantial acceptance for a variety of reasons. One of the main problems with prior known devices is their inability to provide a plurality of aperture sizes in accordance with the particular needs of the smoker as dictated by personal preference and the brand of cigarette with which the item is employed; for example, one would not wish to admit as much air to a low tar cigarette as a high tar cigarette and adjustment capability for air flow is very desirable.

Another disadvantage of prior known devices is that such devices are easily lost or misplaced and consequently not used.

The prior known patents known to Applicant related to devices in this field are as follows:

U.S. Pat. Nos., Des. 195,732; Des. 245,347; 174,488, 268,960; 367,800; 594,031; 738,540; 745,846; 925,158; 929,414; 1,630,243; 1,974,242; 3,693,193; 2,694,399; 2,823,680; 2,854,010; 2,967,528; 2,983,044; 3,080,872; 3,116,741; 3,124,143; 3,143,115; 3,158,157; 3,232,298; 3,232,299; 3,250,279; 3,289,678; 3,405,718; 3,742,963; 3,918,462; 4,046,152 and 4,054,146.

Therefore, it is the primary object of this invention to provide a new and improved cigarette punching device.

Yet another object of the invention is the provision of a new and improved cigarette puncher capable of being used for providing apertures of selected desired size in a particular cigarette.

Yet another object of the invention is the provision of a new and improved cigarette punch means which is easily attached to and retained with an opened pack of cigarettes so as to always be available for use.

Yet another object of the invention is the provision of a new and improved cigarette punch device mounted on a cigarette lighter which is connectable to an opened cigarette pack for the convenience of the user.

Achievement of the foregoing objects is enabled by the first embodiment of the invention through the provision of a body member formed of plastic or metal comprising an elongated clip portion dimensioned to be fitted in the opened end of a cigarette pack and an outer punch carrier portion dimensioned to extend downwardly along the outer side edge of the pack with the clip portion and the punch carrier portion being joined by a curved connector portion.

The punch carrier portion and the clip portion include aligned elongated slots which define an elongated guide plate of a width permitting the insertion of a cigarette with a rotary punch support being provided on the punch carrier portion at the lower end of the slot. The rotary punch support supports a plurality of punches, each of different diameter and each having a canted end with a sharp edge surface with the rotary member being moved to a selected position in conjunction with detent means on the punch carrier portion to position a desired one of the punch members at the lower end of the elongated guide slot.

In use, a cigarette is positioned in the guide slot above the punch and moved downwardly against the punch at the lower end of the slot to effect the punching of an aperture in the paper of a cigarette. An additional feature of the preferred embodiment includes a lift tab member extending outwardly from the lower end of the clip portion onto which a cigarette can easily be positioned so that upward movement of the clip member lifts the cigarette outwardly of the package to present it to the user.

In a second embodiment, the clip member is attached to a cigarette lighter with the lower end of the lighter having first and second spaced guide ears which define an elongated guide slot into which a cigarette can be positioned. A punch member is provided at the bottom of the guide slot to permit the user to effect the punching of an aperture in the cigarette paper.

A better understanding of the preferred embodiment will be achieved when the following detailed description is considered in conjunction with the appended drawings in which:

FIG. 1 is a perspective view of a cigarette pack with the first embodiment mounted thereon;

FIG. 2 is a perspective view illustrating the manner of using the first embodiment for effecting a punching of an aperture in a cigarette;

FIG. 3 is a perspective view of the first embodiment illustrating the cigarette lift tab portion prior to insertion of the device in a cigarette pack;

FIG. 4 is a perspective view similar to FIG. 3 but illustrating the operation of the lift tab portion for presenting a cigarette to the user;

FIG. 5A is a perspective view of the end of a punch member of the type employed in the first embodiment and the second embodiment;

FIG. 5B is a perspective view illustrating the type of opening provided in cigarette paper by the invention;

FIG. 5C is a perspective view illustrating the punch opening made in cigarette paper by a conventional punch;

FIG. 6 is a front elevation view of the first embodiment;

FIG. 7 is a sectional view taken along lines 7—7 of FIG. 6;

FIG. 8 is a perspective view of a cigarette pack having a second embodiment partially inserted therein;

FIG. 9 is a perspective view of a second embodiment as inserted in an alternative manner in a cigarette pack; and FIG. 10 is a perspective view illustrating the manner of using the second embodiment.

The first embodiment of the invention, as illustrated in FIGS. 1 through 7, comprises a body member, generally designated 10, formed of plastic or alternatively metal, and which consists of a clip portion 12 dimensioned to be insertable in a cigarette pack P and a punch carrier portion 14 joined to clip portion 12 by a curved connector portion 16 which has outwardly bulging shoulders 17 and medial protrusions 15. An elongated guide slot 18 extends through both the punch carrier portion 14 and the clip portion 12 and is of a width to permit the insertion of a cigarette therein. Shoulders 17 keep the fingers from sliding off the device when it is being moved upwardly.

A rotary punch carrier turret 20 is mounted on a pivot pin 22 supported on punch carrier portion 14 in a recessed manner and has a selector lever 24 having a positioning recess engageable with anyone of three detent protrusions 25 to selectively position the rotary turret 20 in a desired position so as to position a desired one of three punch members 26, 28 and 30 in the lower end of the slot 18. The punch members 26, 28 and 30 are of progressively greater diameter with each of the punch members having a canted upper end 32 with a sharp tip 33 as shown in FIG. 5A.

The lower end of the clip portion 12 is provided with a cigarette lift tab 34 which can be inserted in the edge of a cigarette pack after the removal of one cigarette as shown in FIG. 3. A cigarette in the pack is then easily joggled into position on lift tab 34 for permitting the lifting of the cigarette from the pack in a manner to be discussed. It should be observed that the width of the clip portion is such as to permit its insertion between the front and rear surfaces of the pack adjacent the relatively narrow side edge portion of the pack P. Also, lift tab 34 is positioned lower than the lower edge of clip portion 12 to enhance movement of a cigarette onto the table when the device is fully inserted in a cigarette pack as shown in FIG. 1.

In use, the device is positioned in a cigarette pack with a "stop" line 99 aligned with the upper end of the pack; a cigarette is positioned in an upper portion of the slot 18 as shown at 40' of FIG. 7 and also as similarly shown in FIG. 2. The cigarette is then moved downwardly to position 40" to impale it on the punch member 28 (or any of the other two punch members which happen to be positioned in slot 18 in accordance with the setting of the selector lever 24). Medical protrusions 15 engage the thumb and finger of the user to resist downward movement of the device during the punching operation.

Another aspect of the preferred embodiment resides in the employment of the lift tab 34 for lifting a cigarette from the pack to present the cigarette to the user. This purpose is accomplished by first inserting the device into the pack in the direction of arrow 35 after at least a single cigarette has been removed therefrom as shown in FIG. 3. The lift tab 34 is consequently positioned at the bottom of the pack adjacent a corner portion thereof which it punches downwardly and tilting movement of the pack easily effects the positioning of a cigarette 48 on the lift tab 34. Upward movement of the device lifts the cigarette 48 upwardly to the position shown in FIG. 4 at which the cigarette is presented to the user. Such upward movement is easily enabled by virtue of manual engagement with the protrusions 15 of the sides of the punch carrier portion 14 as shown.

The second embodiment of the invention also includes a clip portion 41 which is joined to a cigarette lighter 42 with the clip portion 41 being insertable in the side edge of the pack P in the same manner as the first embodiment. The lower end of the lighter portion 42 includes two spaced ears 44 between which a single punch member 46 is provided. The spaced ears 44 define a guide slot for effecting the punching of a cigarette 40 as shown in FIG. 10. The outer end of the punch member 46 is the same as shown in FIG. 5. After a sufficient number of cigarettes have been removed from the pack, the second embodiment can be reversely positioned to position the cigarette lighter component 42 inside the pack and clip 41 outside the pack as shown in FIG. 9.

One very important aspect of both embodiments is the shape of the outer end of the punch members with the outer end surface 32 lying in a plane canted at an acute angle to the axis of the punch members to define cutting edge 33 which cuts the cigarette paper to provide an elongated opening 92 in the paper as shown in FIG. 5B as opposed to One of the important disadvantages of the previous known devices and patents is that none recognizes the importance of how the punchers affect the perforation of the cigarette. Through tests, it was discovered that any perforations made through the cigarette paper or filter material with a conical point puncher or similar puncher will tear the paper to form the perforation and that causes a subsequent substantial closure of the opening by the humidity and pressure of the tobacco as the cigarette is smoked and consequently the opening becomes almost ineffective.

The advantage and benefit of this new inventive cigarette puncher allows the user to cut any kind of cigarette paper without tearing the paper or the material surrounding the filter. This provides the same infiltration amount of air from the beginning to the end of the smoking of a cigarette and gives complete benefit and satisfaction to the user.

Another important advantage of this new puncher is to give the user the selectivity of the puncher size in which the smoker can switch from the smallest to the biggest gradually and this gives the user the chance to gradually decrease the tar in the smoke and allows the smoker to get used to the more milder and lighter taste of the cigarette gradually to help the user to quit smoking.

Another disadvantage of previous puncher devices is that to be able to satisfy the smoker to give a mild and light taste to the cigarette they must provide more than one opening in the cigarette paper and that may easily cause a split in the area where the cigarette was perforated and discourage the user to use it.

Numerous modifications of the preferred embodiment will undoubtedly occur to those of skill in the art and it should consequently be understood that the spirit and scope of the invention is to be limited solely by the appended claims.

I claim:

1. A cigarette puncher comprising a body member, an elongated guide slot in said body member of a width permitting the snug insertion of the end of a cigarette therein and an elongated punch member mounted in one end of said elongated guide slot having an axis parallel to the axis thereof, whereby a cigarette positioned in said slot can be moved into engagement with said elongated punch member to effect the punching of an aperture in the paper of the cigarette, wherein said body member includes a clip portion, a punch carrier portion connected to the clip portion by a bent end connector portion with the clip portion being of a width to be received snugly within one end of a cigarette pack and additionally including a rotary punch support means mounted on said punch carrier portion and having a plurality of individual punch members of different diameter mounted thereon.

2. The invention of claim 1 wherein said rotary punch support means includes an actuator lever engageable with detent means so as to be positionable in one of several different positions with each of said different positions correspondingly positioning one of said punch members in the lower end of said elongated guide slot.

3. The invention of claim 1 additionally including a cigarette lift tab on a lower end of the clip portion to be positioned at the bottom of the pack when the clip portion is received in the pack.

4. The invention of claim 3 wherein said rotary punch support means includes an actuator lever engageable with detent means so as to be positionable in one of three different positions with each of said different positions correspondingly positioning one of said punch members in the lower end of said elongated guide slot.

5. The invention of claim 1 wherein said punch members are of cylindrical shape and have an outer cutter end planar surface canted at an acute angle with respect to the axis of the punch member.

6. A cigarette puncher comprising a body member, an elongated closed ended guide slot in said body member of a width permitting the snug insertion of the end of a cigarette therein and an elongated punch member of generally cylindrical shape having an outer cutter end planar surface canted at an acute angle with respect to its axis mounted in one end of said elongated guide slot having an axis parallel to the axis thereof, whereby a cigarette positioned in said slot can be moved into engagement with said elongated punch member to effect the punching of an aperture in the paper of the cigarette and wherein said body member includes a clip portion and a punch carrier portion, said clip portion being dimensioned to be received in one end of a cigarette pack having parallel front and rear relatively large panels joined by parallel end panels of smaller size with said clip portion being of a width slightly less than the width of the end panels and said body member further including a bent end connector portion connecting said punch carrier portion to said clip portion and wherein said closed ended guide comprises first and second aligned slot portions respectively provided in the punch carrier portion and the clip portion.

7. The invention of claim 6 wherein said punch carrier portion includes a rotary punch support means from which a plurality of different diameter punch members extend.

8. The invention of claim 7 wherein said rotary punch means includes an actuator lever engageable with detent means so as to be positionable in each one of a plurality of portions correspondingly positioning one of said punch members in one end of said elongated closed ended guide slot.

* * * * *